US009031458B2

(12) United States Patent
Itabashi et al.

(10) Patent No.: US 9,031,458 B2
(45) Date of Patent: May 12, 2015

(54) PROCESS UNIT HAVING DRUM CARTRIDGE AND DEVELOPER CARTRIDGE

(71) Applicants: Nao Itabashi, Nagoya (JP); Naoya Kamimura, Ichinomiya (JP)

(72) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 64 days.

(21) Appl. No.: 13/689,982

(22) Filed: Nov. 30, 2012

(65) Prior Publication Data

US 2013/0136494 A1 May 30, 2013

(30) Foreign Application Priority Data

Nov. 30, 2011 (JP) ..... 2011-261254

(51) Int. Cl.
*G03G 21/18* (2006.01)

(52) U.S. Cl.
CPC ..... *G03G 21/1814* (2013.01); *G03G 21/1821* (2013.01)

(58) Field of Classification Search
CPC combination set(s) only.
See application file for complete search history.

(56) References Cited

U.S. PATENT DOCUMENTS

| | | | |
|---|---|---|---|
| 7,920,807 | B2 | 4/2011 | Tomatsu |
| 8,768,212 | B2 | 7/2014 | Hashimoto et al. |
| 2009/0175652 | A1 | 7/2009 | Kamimura |
| 2009/0220273 | A1 | 9/2009 | Tomatsu |
| 2011/0150528 | A1 | 6/2011 | Tomatsu |
| 2012/0163859 | A1 | 6/2012 | Hashimoto et al. |

FOREIGN PATENT DOCUMENTS

| | | |
|---|---|---|
| JP | 2009-162912 | 7/2009 |
| JP | 2009-210631 | 9/2009 |
| JP | 2012-137556 | 7/2012 |

*Primary Examiner* — Clayton E Laballe
*Assistant Examiner* — Jas Sanghera
(74) *Attorney, Agent, or Firm* — Banner & Witcoff, Ltd.

(57) ABSTRACT

A process unit includes a photosensitive unit, a developer unit, a first urging member, and a second urging member. The first urging member urges the developer unit with a first urging force when the developer unit is in a contact position where a developing member contacts a photosensitive drum. The first urging member urges the developer unit with a second urging force greater than the first urging force when the developer unit is in a separated position where the developing member is separated from the photosensitive drum. The second urging member urges the developer unit with a third urging force smaller than the first urging force when the developer unit is in the contact position. The second urging member urges the developer unit with a fourth urging force smaller than the third urging force when the developer unit is moved from the separated position to the contact position.

9 Claims, 12 Drawing Sheets

6
8
31
32
32(31)
33
34
35
36
37
39
41
42
43
44
45
46
47
48
49
TOP
RIGHT
FRONT
BOTTOM
REAR
LEFT

PROCESS UNIT HAVING DRUM CARTRIDGE AND DEVELOPER CARTRIDGE

CROSS REFERENCE TO RELATED APPLICATION

This application claims priority from Japanese Patent Application No. 2011-261254 filed Nov. 30, 2011. The entire content of this priority application is incorporated herein by reference.

TECHNICAL FIELD

The present invention relates to process units and photosensitive units each detachably mounted in an image-forming device employing an electrophotographic system.

BACKGROUND

One electrophotographic printer known in the art is a color printer comprising a plurality of photosensitive members for each of the plurality of colors used by the printer, and a plurality of corresponding developing units for supplying toner respectively to the photosensitive members. This color printer can switch between a monochrome mode for forming black-only images, and a color mode for forming color images.

One such color printer that has been proposed includes drum cartridges, each of which has a photosensitive drum, and developer cartridges respectively mounted on the drum cartridges. In this printer, pressing levers are provided on the drum cartridges for constantly pressing the developer cartridges toward the respective photosensitive drums. A separating member is also provided in a main casing of the printer. When the printer is switched from the color mode to the monochrome mode, the separating member presses bearing members holding the shafts of developing rollers in the respective developer cartridges for the colors yellow, magenta, and cyan, thereby urging the bearing members in a direction away from the corresponding photosensitive drums. As a result, the developer cartridges are separated from the photosensitive drums against the force of the pressing levers.

SUMMARY

However, when the conventional printer described above is switched back from the monochrome mode to the color mode, the pressing levers apply a force to the separated developer cartridges for moving the cartridges toward the photosensitive drums until the developer rollers contact the corresponding photosensitive drums. Hence, when moving the separated developer cartridges toward the corresponding photosensitive drums, the pressing levers must possess a relatively large pressing force in order to reliably place the developing rollers in contact with the photosensitive drums. Once the developing rollers are in contact with the photosensitive drums, however, the pressing levers require a relatively light pressing force so that the developing rollers are not pressed too firmly against the photosensitive drums.

In view of the foregoing, it is an object of the present invention to provide process units capable of placing the developing rollers in reliable contact with the photosensitive drums and capable of suitably adjusting the force with which the developing rollers are pressed against the photosensitive drums.

In order to attain the above and other objects, the invention provides a process unit. The process unit includes a photosensitive drum, a developer unit, a first urging member, and a second urging member. The photosensitive unit is provided with a photosensitive body. The developer unit is provided with a developing member configured to carry developing agent thereon. The developer unit is configured to move between a contact position where the developing member is in contact with the photosensitive body and a separated position where the developing member is separated from the photosensitive body. The first urging member is configured to urge the developer unit so as to move the developer unit from the separated position to the contact position. The first urging member is configured to urge the developer unit with a first urging force when the developer unit is in the contact position. The first urging member is configured to urge the developer unit with a second urging force greater than the first urging force when the developer unit is in the separated position. The second urging member is configured to urge the developer unit so as to move the developer unit from the contact position to the separated position. The second urging member is configured to urge the developer unit with a third urging force smaller than the first urging force when the developer unit is in the contact position. The second urging member is configured to urge the developer unit with a fourth urging force smaller than the third urging force when the developer unit is moved from the separated position to the contact position.

According to another aspect, the present invention provides a photosensitive unit. A developer unit provided with a developing member is detachably mounted to the photosensitive unit. The photosensitive unit includes a photosensitive body, a first urging member, and a second urging member. The developer unit is movable between a contact position where the developing member is in contact with the photosensitive body and a separated position where the developing member is separated from the photosensitive body. The first urging member is configured to urge the developer unit so as to move the developer unit from the separated position to the contact position. The first urging member is configured to urge the developer unit with a first urging force when the developer unit is in the contact position. The first urging member is configured to urge the developer unit with a second urging force greater than the first urging force when the developer unit is in the separated position. The second urging member is configured to urge the developer unit so as to move the developer unit from the contact position to the separated position. The second urging member is configured to urge the developer unit with a third urging force smaller than the first urging force when the developer unit is in the contact position. The second urging member is configured to urge the developer unit with a fourth urging force smaller than the third urging force when the developer unit is moved from the separated position to the contact position.

BRIEF DESCRIPTION OF THE DRAWINGS

The particular features and advantages of the invention as well as other objects will become apparent from the following description taken in connection with the accompanying drawings, in which:

FIG. 2(*b*) is an enlarged view showing an encircled portion of FIG. 2(*a*) according to the first embodiment of the present invention;

FIG. 9(*b*) is a cross-sectional view of the process cartridge taken along a line B-B of FIG. 8 when the developer cartridge is in the contact position according to the second embodiment of the present invention;

FIG. 10(*b*) is a cross-sectional view of the process cartridge taken along the line B-B of FIG. 8 when the developer cartridge is in the separated position according to the second embodiment of the present invention;

FIG. 11(*b*) is a schematic view of the process cartridge when the developer cartridge is in a separated position according to the third embodiment of the present invention;

FIG. 12(*b*) is a schematic view of the process cartridge when the developer cartridge is in a separated position according to the fourth embodiment of the present invention.

DETAILED DESCRIPTION

1. Overall Structure of a Printer

Figure 1:
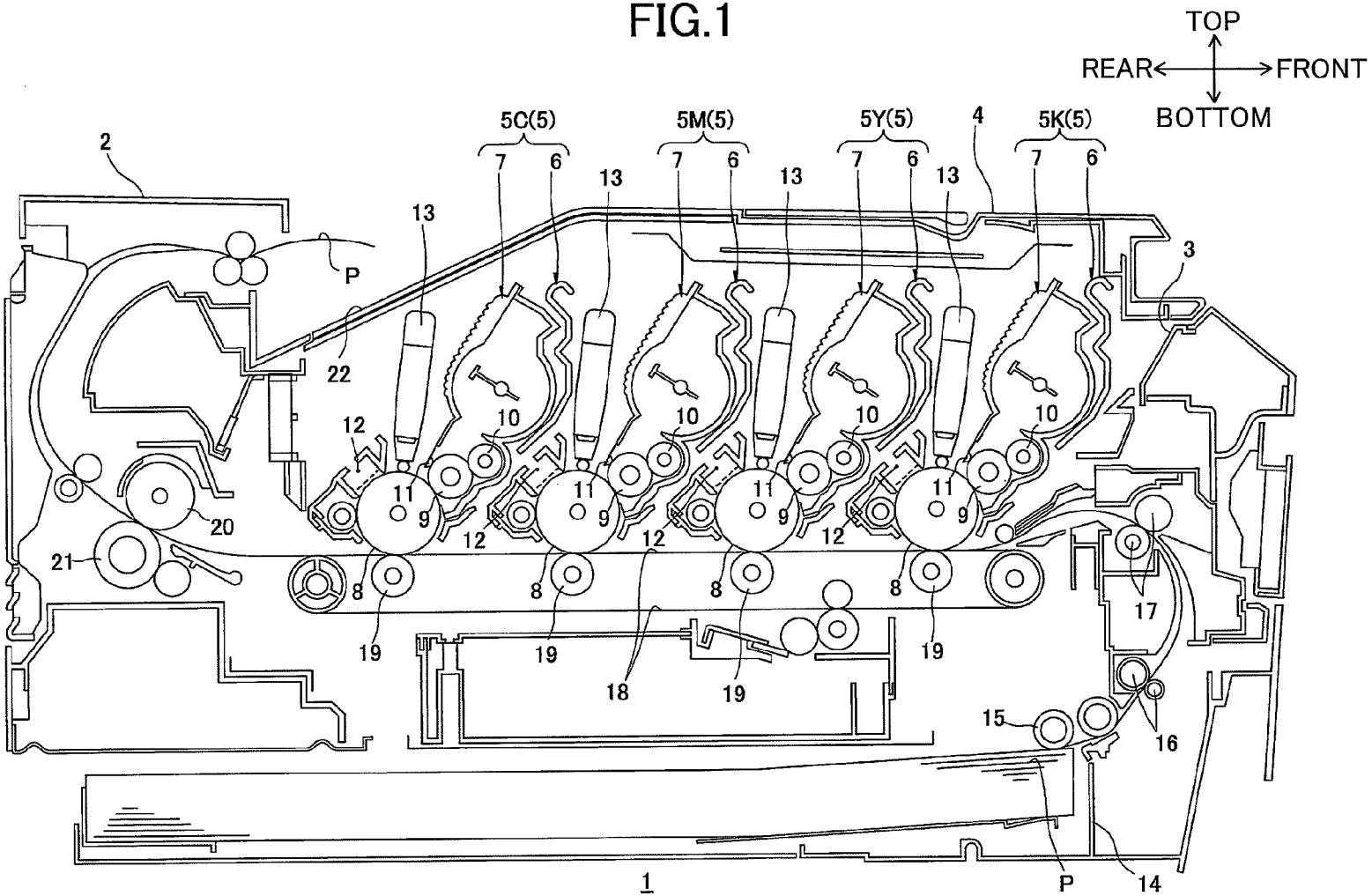
FIG. 1 is a central cross-sectional view of a printer according to a first embodiment of the present invention.

A printer 1 shown in FIG. 1 is a horizontal direct tandem-type color printer.

Directions with respect to the printer 1 in the following description will be given under the assumption that the printer 1 is resting on a level surface. The left side of the printer 1 in FIG. 1 will be considered the rear side, while the right side will be considered the front side. Left and right sides of the printer 1 will be determined based on the perspective of a user facing the front of the printer 1. In other words, the near side of the printer 1 in FIG. 1 will be considered the left side, while the far side will be considered the right side.

The printer 1 includes a main casing 2 that has a general box shape. The main casing 2 has a top portion formed with an access opening 3. A top cover 4 is pivotably provided on the top portion of the main casing 2 over the access opening 3 and is capable of pivoting about its rear edge to expose or cover the access opening 3.

The printer 1 also includes four process cartridges 5. The process cartridges 5 are all detachably mounted in the main casing 2 through the access opening 3 formed in the top portion of the main casing 2. The process cartridges 5 are disposed in parallel and spaced at intervals in the front-rear direction. The four process cartridges 5 are provided for each of the four colors (black, yellow, magenta, and cyan) used in the printer 1 and are arranged from front to rear in order of a black process cartridge 5K, a yellow process cartridge 5Y, a magenta process cartridge 5M, and a cyan process cartridge 5C.

Each of the process cartridges 5 includes a drum cartridge 6, and a developer cartridge 7 detachably mounted in the corresponding drum cartridge 6. The drum cartridge 6 is provided with a photosensitive drum 8. The photosensitive drum 8 has a cylindrical shape and is oriented with its axis aligned in the left-right direction. The photosensitive drum 8 is rotatably disposed in the drum cartridge 6.

Figure 4:
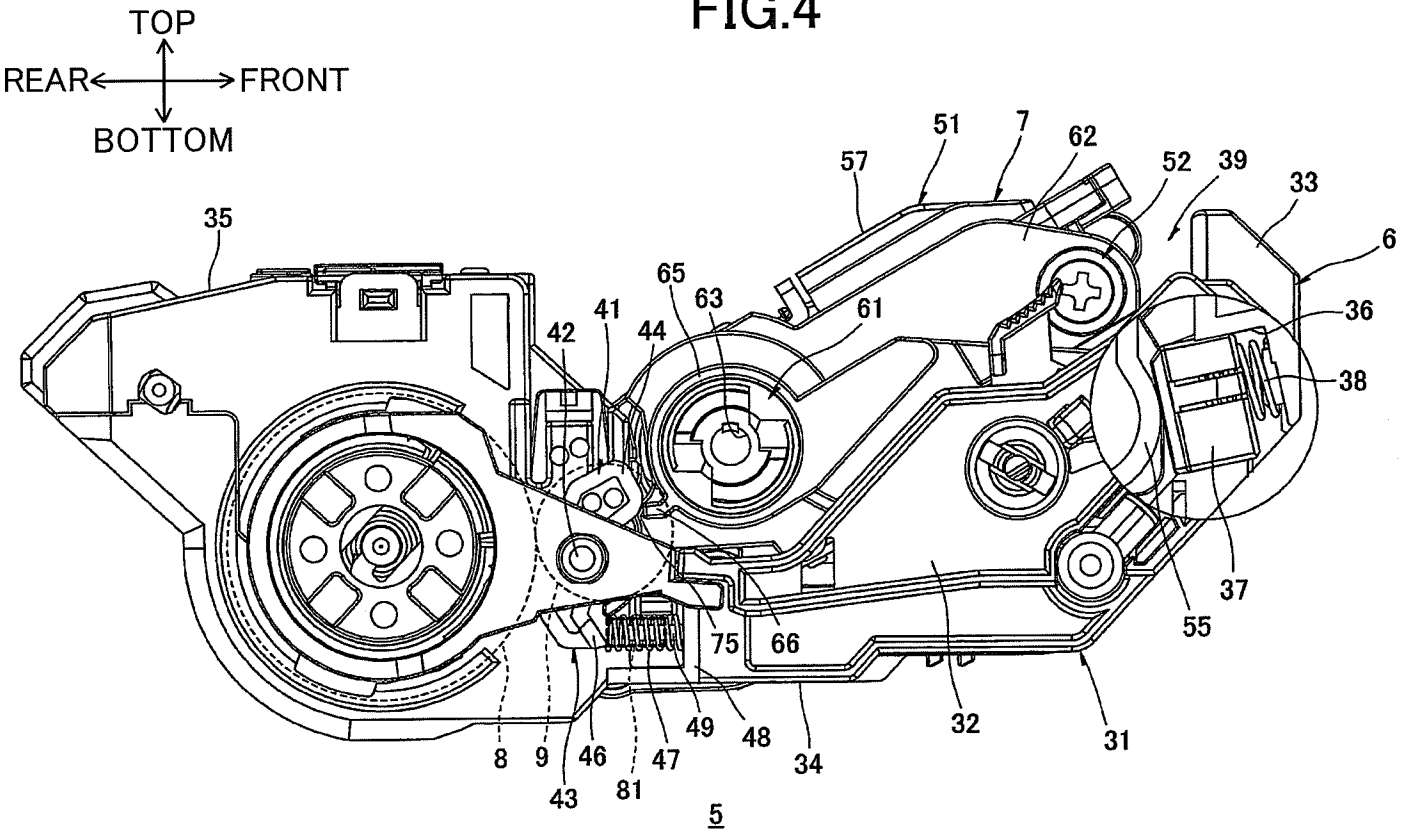
FIG. 4 is a left side view of the process cartridge when the developer cartridge is positioned at a contact position according to the first embodiment of the present invention.
Figure 5:
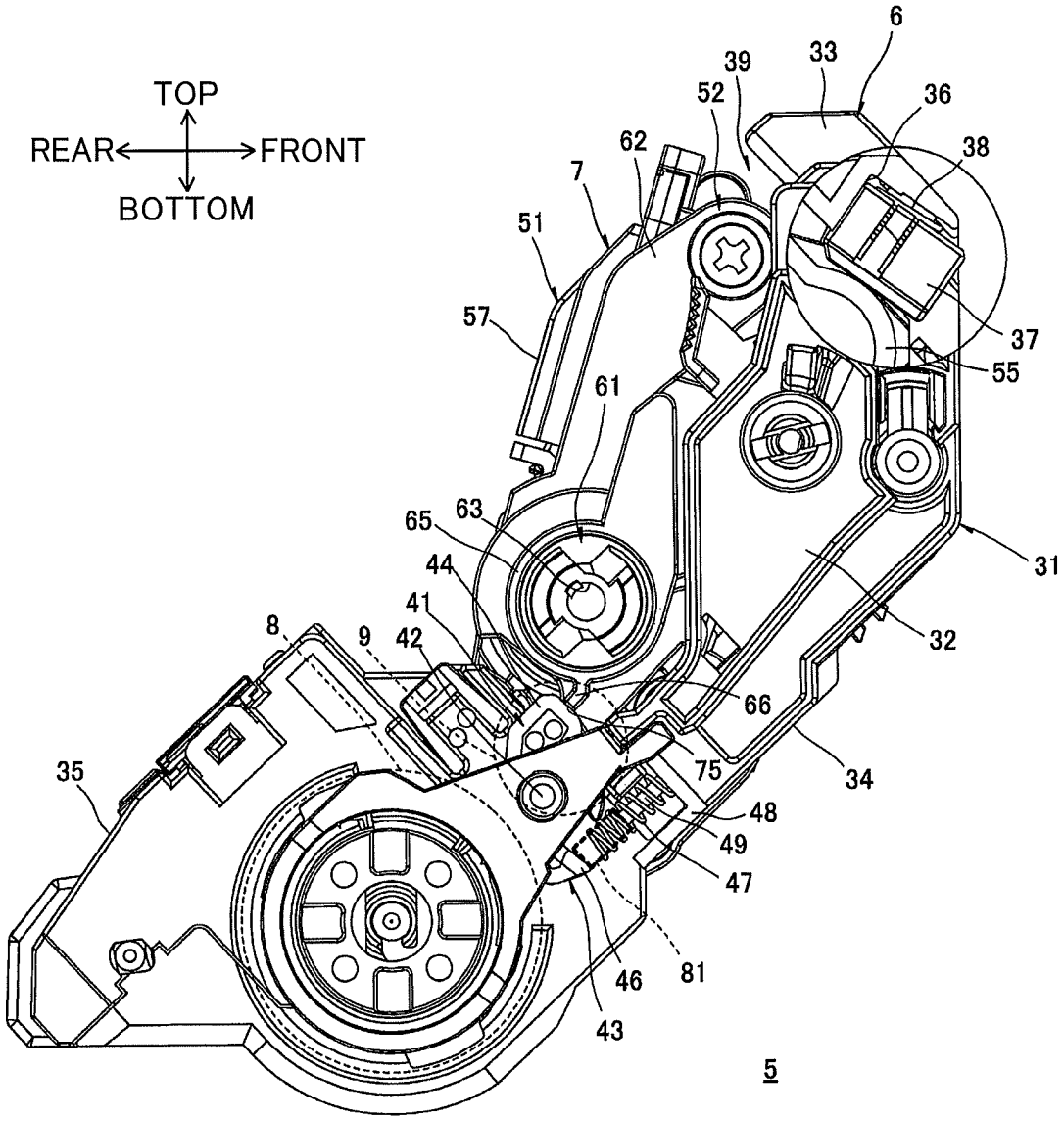
FIG. 5 is a left side view of the process cartridge when the developer cartridge is positioned at a separated position according to the first embodiment of the present invention.

The developer cartridge 7 is movable in the drum cartridge 6 in front-rear direction in FIG. 4 between a contact position where the developing roller 9 is in contact with the photosensitive drum 8 as shown in FIG. 4 and a separated position where the developing roller 9 is separated from the photosensitive drum 8 as shown in FIG. 5. The developer cartridge 7 is provided with a developing roller 9. The developing roller 9 is provided in the rear end of the developer cartridge 7 with its axis aligned in the left-right direction (axial direction). The peripheral surface of the developing roller 9 is exposed through the rear side of the developer cartridge 7 and contacts the upper front side of the photosensitive drum 8.

The developer cartridge 7 also includes a supply roller 10 for supplying toner to the developing roller 9, and a thickness-regulating blade 11 for regulating the thickness of toner carried on the developing roller 9. The upper section of the developer cartridge 7 serves to accommodate toner.

When the supply roller 10 supplies toner from the developer cartridge 7 to the developing roller 9, the toner is positively tribocharged between the supply roller 10 and the developing roller 9. The thickness-regulating blade 11 maintains the layer of toner carried on the surface of the developing roller 9 at a thin uniform thickness.

In the meantime, a scorotron charger 12 disposed in confrontation with the upper rear side of the photosensitive drum 8 applies a uniform charge to the surface of the photosensitive drum 8. Subsequently, an LED unit 13 disposed in confrontation with the top surface of the photosensitive drum 8 radiates light on the surface of the photosensitive drum 8 based on prescribed image data, forming an electrostatic latent image on the surface. Next, the toner carried on the surface of the developing roller 9 is supplied to electrostatic the latent image formed on the surface of the photosensitive drum 8, developing the electrostatic latent image into a toner image.

The main casing 2 has a bottom section provided with a paper tray 14 for accommodating sheets P of paper. A pickup roller 15, a pair of feeding rollers 16, and a pair of registration rollers 17 convey the sheets along a U-shaped path for redirecting the sheets back in the rearward direction and supply the sheets one at a time onto a conveying belt 18 at a prescribed timing. The conveying belt 18 continues to convey each sheet rearward between the photosensitive drums 8 and corresponding transfer rollers 19. At this time, toner images of all four colors formed on the photosensitive drums 8 are sequentially transferred onto the sheet P to form a color image thereon.

The sheet P subsequently passes between a heating roller 20 and a pressure roller 21. The heating roller 20 and the pressure roller 21 apply heat and pressure, respectively, to the sheet P for fixing the color image. Next, the sheet P is conveyed along a U-shaped path that redirects the sheet P upward and forward, and then the sheet P is discharged onto a discharge tray 22 provided on the top cover 4.

2. Detailed Description of the Process Cartridges (1) Drum Cartridges (1-1) Drum Frame Directions with respect to the drum cartridge 6 in the following description will be given under the assumption that the drum cartridge 6 is lying flat in a horizontal plane with a bottom wall 34 on the bottom (see FIG. 2). Further, the side of the drum cartridge 6 in which the photosensitive drum 8 is provided will be considered the rear side.

Figures 2A, 2B:
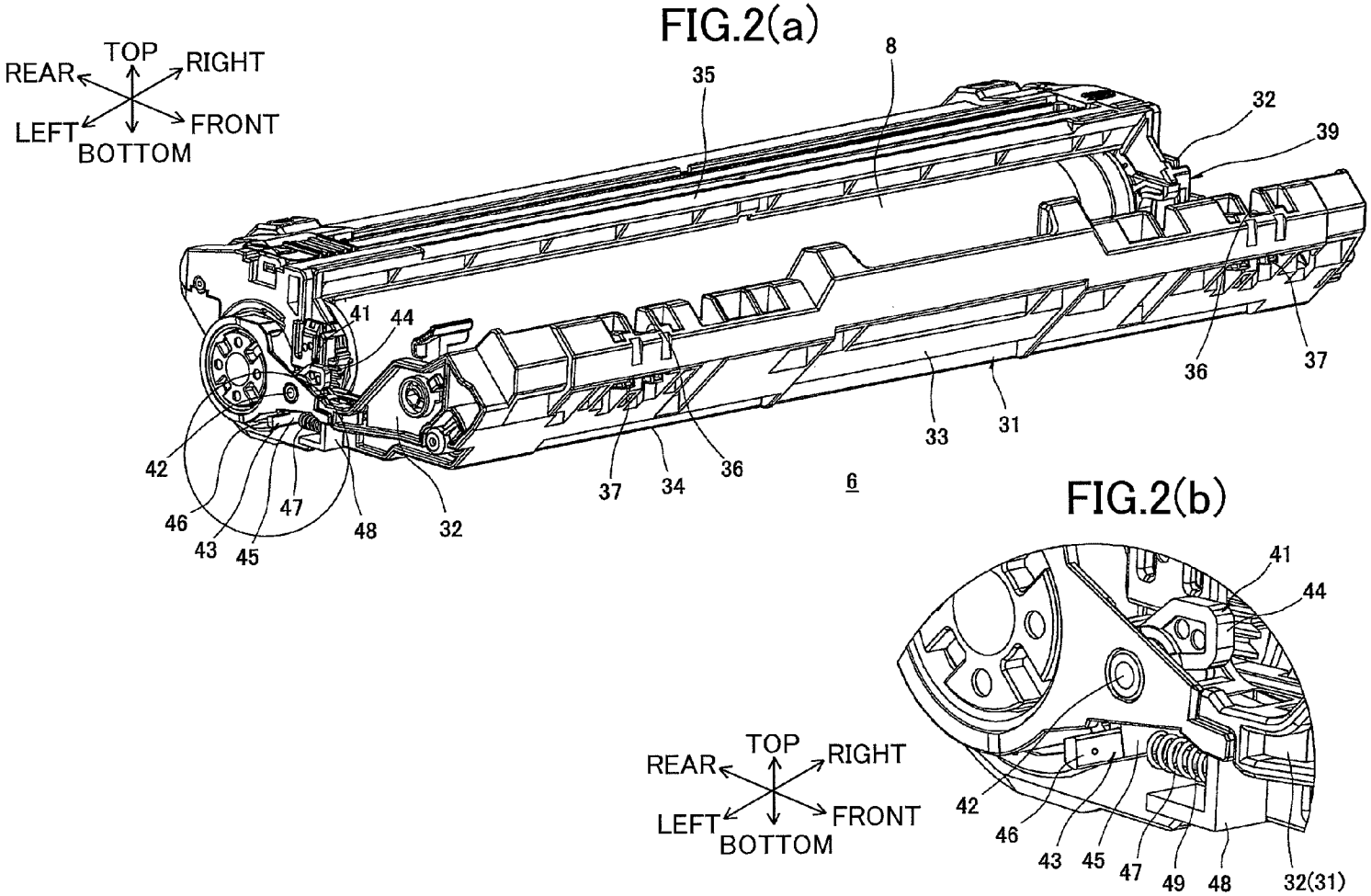
FIG. 2(*a*) is a perspective view of a drum cartridge as viewed from diagonally front and left according to the first embodiment of the present invention.

As shown in FIG. 2, the drum cartridge 6 includes a drum frame 31 having a generally rectangular frame-like shape with a closed bottom. The drum frame 31 is provided with a pair of left and right side walls 32, a front wall 33 bridging the front ends of the side walls 32, a bottom wall 34 bridging the bottom edges of the side walls 32, and an upper wall 35 bridging the rear ends of the side walls 32.

The side walls 32 are generally rectangular in a side view and elongated in the front-rear direction. The front wall 33 has a generally flat plate shape and is elongated in the left-right direction. The bottom wall 34 has a generally flat plate shape and is elongated in the front-rear and left-right directions. The bottom wall 34 is formed continuously with the bottom edge of the front wall 33. The upper wall 35 has a generally flat plate shape and is elongated in the left-right direction. The upper wall 35 is disposed so as to cover the top of the photosensitive drum 8. The scorotron charger 12 is supported on the upper wall 35.

The drum frame 31A is formed with a developer cartridge mounting unit 39 in which a corresponding developer cartridge 7 is mounted. The developer cartridge mounting unit 39 is defined by the front half of the bottom wall 34, the portions of the side walls 32 corresponding to the front half of the bottom wall 34, the front wall 33, and the front edge of the upper wall 35.

(1-2) Pressing Members

As shown in FIGS. 2 and 4, two pressing member accommodating units 36 are formed in the front wall 33 of the drum frame 31 at positions facing the developer cartridge mounting unit 39. One each of a pressing member 37 and a first urging member 38 are provided in each of the pressing member accommodating units 36. One of the pressing member accommodating units 36 is provided on each of the left and right ends of the front wall 33. The pressing member accommodating units 36 are generally rectangular in a front side view and depressed forward from the rear surface of the front wall 33.

The pressing members 37 have a square columnar shape that is generally rectangular in a front view. The pressing members 37 are supported in the corresponding pressing member accommodating units 36 in a manner to be capable of sliding in the front and rear directions.

The first urging members 38 are helical compression springs that can compress in the direction that the pressing members 37 slide. Each first urging member 38 is interposed between the front end portion of the corresponding pressing member 37 and the front wall of the corresponding pressing member accommodating unit 36.

With this configuration, the pressing members 37 are urged to advance rearward out of the pressing member accommodating units 36 while the developer cartridge 7 is not mounted in the drum cartridge 6. Note that restricting members (not shown) restrict the pressing members 37 from advancing too far rearward at this time. Further, the first urging members 38 are compressed to a length slightly shorter than the extended length of the first urging members 38 during a no-load condition.

(1-3) Separating Members and Second Urging Members

As shown in FIGS. 2 and 5, separating members 41 are provided in the rear portion of the developer cartridge mounting unit 39, with one disposed on the outside of each of the left and right side walls 32. Supporting parts 48 are provided obliquely forward and downward of the separating members 41, with one on the outside of each of the left and right side walls 32. Second urging members 47 are respectively supported in the supporting parts 48.

Each separating member 41 is integrally provided with a rotational shaft 42, a pressure-receiving part 43, and an operating part 44. The rotational shaft 42 has a generally columnar shape and extends in the left-right direction.

The pressure-receiving part 43 has a generally flat plate shape and extends downward from the bottom portion of the rotational shaft 42. The bottom portion of the pressure-receiving part 43 is bent forward. The pressure-receiving part 43 includes a first contact part 45 for contacting the respective second urging member 47, and a second contact part 46 for contacting a corresponding body-side lever 81 (described later with reference to FIG. 5) disposed in the main casing 2. The first contact part 45 is provided on the distal end (lower end) of the pressure-receiving part 43. The second contact parts 46 are generally rod-shaped and extend outward in left and right directions, respectively, from outer left and right ends of the corresponding first contact parts 45.

The operating part 44 has a generally flat plate shape and extends upward from the upper portion of the rotational shaft 42. The upper portion of the operating part 44 bends forward.

The separating members 41 are rotatably supported on the corresponding side walls 32 via the rotational shaft 42. Each separating member 41 can rotate about the rotational shaft 42 between a first position (see FIG. 4) in which the pressure-receiving part 43 contacts the second urging member 47, and a second position (see FIG. 5) in which the pressure-receiving part 43 is retracted rearward from the second urging member 47.

The supporting parts 48 are formed in a general L-shape in a side view and protrude outward in left and right directions, respectively from the outer left and right surfaces of the corresponding side walls 32. Each supporting part 48 has a restricting shaft 49 for restricting movement of the second urging member 47 in the compressing direction.

The restricting shaft 49 has a generally cylindrical shape and protrudes rearward from the front wall of the supporting part 48. The restricting shaft 49 is disposed in a position opposing the front side of the corresponding first contact part 45.

The second urging members 47 are helical compression springs that can be compressed in the front-rear direction. The extended length (length in the front-rear direction) of the second urging members 47 in a no-load condition is greater than the front-rear length of the restricting shafts 49. Further, the inner diameter of the second urging members 47 is larger than the diameter of the restricting shafts 49. The second urging members 47 have a spring constant set smaller than that of the first urging members 38. The front ends of the second urging members 47 are supported on the front walls of the supporting parts 48, with the restricting shafts 49 inserted radially inside the second urging member 47. The rear ends of the second urging members 47 are disposed on the front sides of the pressure-receiving parts 43 constituting the separating members 41 and are capable of contacting the pressure-receiving parts 43.

(2) Developer Cartridges

Directions with respect to the developer cartridge 7 in the following description will be given under the assumption that the developer cartridge 7 is laying flat along a horizontal plane, with a bottom wall 56 of the developer cartridge 7 positioned on the bottom (see FIG. 3). Further, the side of the developer cartridge 7 supporting the developing roller 9 will be considered the rear side, while the side supporting the thickness-regulating blade 11 will be considered the upper side.

Figure 3:
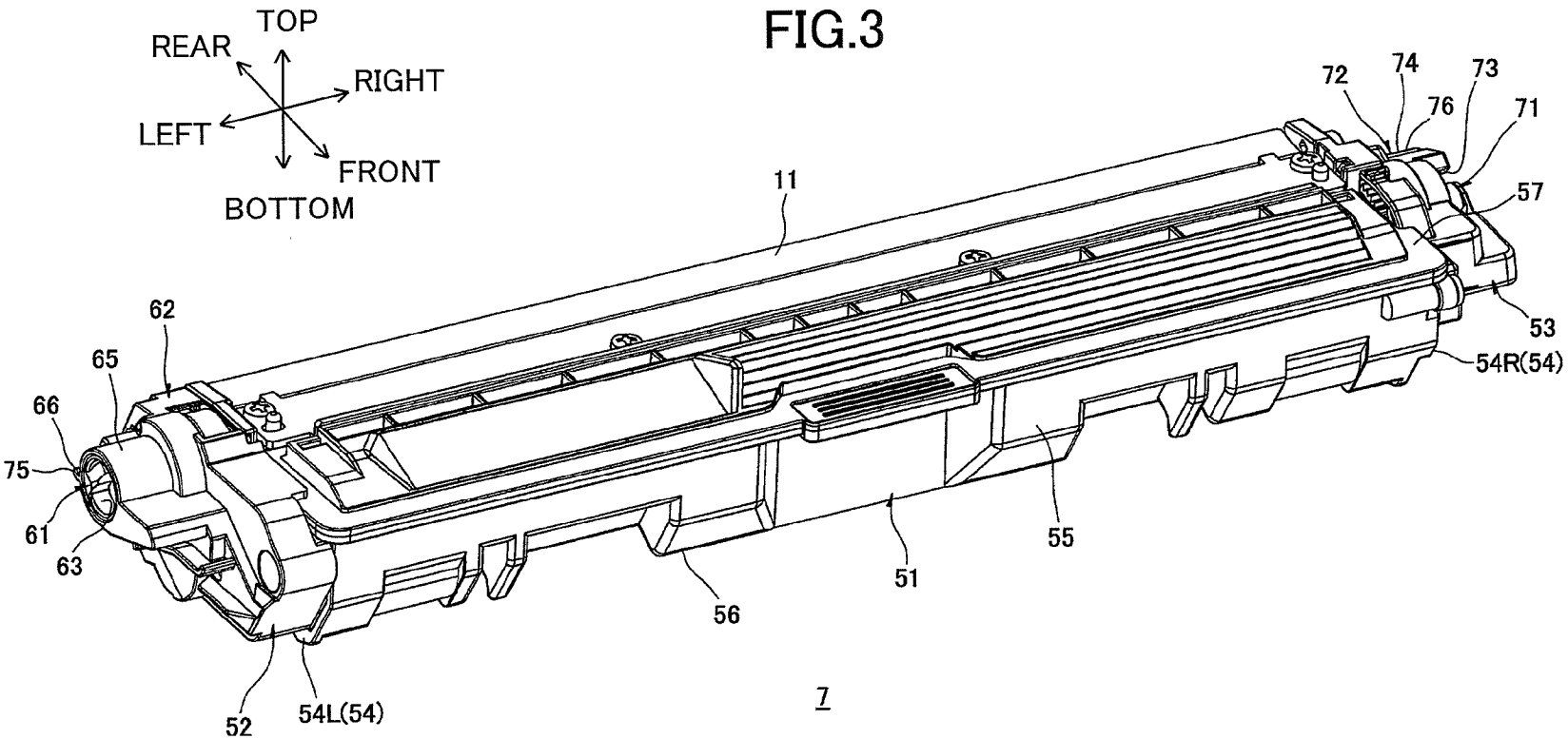
FIG. 3 is a perspective view of a developer cartridge as viewed from diagonally front and left according to the first embodiment of the present invention.

As shown in FIG. 3, the developer cartridge 7 includes a cartridge frame 51, a drive unit 52 disposed on the left side of the cartridge frame 51, and a sensor unit 53 disposed on the right side of the cartridge frame 51.

(2-1) Cartridge Frame

The cartridge frame 51 has a general box shape and is elongated in the left-right direction. The cartridge frame 51 is integrally configured of a pair of left and right side walls 54, a front wall 55, a bottom wall 56, and a top wall 57. In the following description, the left side wall 54 will be called a left wall 54L, and the right side wall 54 will be called a right wall 54R.

The side walls 54 are generally rectangular in a side view and elongated in the vertical and front-rear directions. The side walls 54 are arranged parallel to each other and are spaced apart in the left-right direction. The front wall 55 extends in the left-right direction, bridging the front edges of the side walls 54. The bottom wall 56 extends in the left-right direction, bridging the bottom edges of the side walls 54 and connecting to the bottom edge of the front wall 55. The top wall 57 connects to the top edges of the side walls 54 on the front portions thereof, and the top edge of the front wall 55. The top wall 57 has a flat plate shape that is generally rectangular in a plan view. The thickness-regulating blade 11 is disposed on the rear edge of the top wall 57 so as to contact the top of the developing roller 9.

(2-2) Drive Unit

The drive unit 52 includes a developing roller coupling 61, and a drive-side gear cover 62. The developing roller coupling 61 has a generally columnar shape and extends in the left-right direction. The developing roller coupling 61 is rotatably supported on the left wall 54L. An engaging recession 63 is formed in the left side surface of the developing roller coupling 61 as shown in FIG. 4.

The engaging recession 63 is recessed rightward in the left surface of the developing roller coupling 61 and extends along an axial direction of the developing roller coupling 61 so as to form a generally elongate hole that narrows in its radial center when viewed from the side. When the developer cartridge 7 is mounted in the main casing 2, a distal end of a body-side coupling (not shown) provided in the main casing 2 is inserted into the engaging recession 63 so that the body-side coupling and the engaging recession 63 cannot rotate relative to each other. A rotational drive force inputted into the developing roller coupling 61 is transmitted to the developing roller 9 and the supply roller 10 via a gear train (not shown).

The drive-side gear cover 62 is substantially shaped like a rectangular cylinder closed on the left end and extends in the left-right direction. The drive-side gear cover 62 includes a coupling collar 65, and a first separating member engaging part 66.

The coupling collar 65 has a generally cylindrical shape and protrudes rightward from the left wall of the drive-side gear cover 62 at substantially the front-rear center thereof. The right end of the coupling collar 65 is in communication with the interior of the drive-side gear cover 62.

The first separating member engaging part 66 is formed as a ridge that extends in the left-right direction and protrudes rearward from the rear side of the coupling collar 65. The first separating member engaging part 66 has a rear surface 75 extending vertically.

The drive-side gear cover 62 is fixed with screws to the left wall 54L such that the left end of the developing roller coupling 61 is fitted into the coupling collar 65. The engaging recession 63 is exposed in the left end of the coupling collar 65.

(2-3) Sensor Unit

The sensor unit 53 includes a new-product sensor gear 71, and a sensor-side gear cover 72. The new-product sensor gear 71 is rotatably supported on the right wall 54R. The new-product sensor gear 71 is generally cylindrical in shape and extends in the left-right direction. A rotational drive force is transmitted from the developing roller coupling 61 to the new-product sensor gear 71 via a gear train (not shown). With this configuration, when a new (unused) developer cartridge 7 is mounted in the main casing 2, the new-product sensor gear 71 is irreversibly rotated by a predetermined amount. At this time, a sensor device (not shown) in the main casing 2 detects the rotation of the new-product sensor gear 71, based on which a controller on the main casing 2 side can determine information related to the newness and specifications of the developer cartridge 7.

The sensor-side gear cover 72 is generally shaped as a rectangular cylinder with a closed right end and extends in the left-right direction. An exposure opening 73 for exposing the new-product sensor gear 71 is formed in the sensor-side gear cover 72. The sensor-side gear cover 72 is provided with a second separating member engaging part 74.

The exposure opening 73 has a generally circular shape in a side view and penetrates the right wall of the sensor-side gear cover 72 in approximately the front-rear center thereof. The exposure opening 73 functions to expose the right end of the new-product sensor gear 71.

The second separating member engaging part 74 is formed in a ridge shape that extends in the left-right direction and protrudes rearward from the rear end of the sensor-side gear cover 72. The second separating member engaging part 74 has a rear surface 76 extending vertically similar to the rear surface 75 of the first separating member engaging part 66.

The sensor-side gear cover 72 is fixed with screws to the right wall 54R such that the new-product sensor gear 71 is exposed through the exposure opening 73.

3. Mounting and Removal of the Drum Cartridges Relative to the Developer Cartridges Before mounting the process cartridge 5 in the main casing 2, first the developer cartridge 7 is mounted in the drum cartridge 6. While the developer cartridge 7 is separated from the drum cartridge 6, the separating members 41 are in the second position and the pressure-receiving parts 43 of the separating members 41 are separated from the second urging members 47 on the lower rear side thereof (see FIG. 5). Accordingly, the second urging member 47 is at its extending length in a no-load condition.

To mount the developer cartridge 7 in the drum cartridge 6, first an operator inserts the rear end of the developer cartridge 7 into the rear side of the developer cartridge mounting unit 39. Upon doing so, the first separating member engaging part 66 of the drive-side gear cover 62 and the second separating member engaging part 74 of the sensor-side gear cover 72 contact the operating parts 44 of the corresponding separating members 41 on the front side thereof.

Next, the operator pushes the front end of the developer cartridge 7 into the front side of the developer cartridge mounting unit 39 so that the front end of the developer cartridge 7 pivots clockwise in a left side view about the rear end thereof. As a result, the developer cartridge 7 is accommodated in the developer cartridge mounting unit 39, as shown in FIG. 4, while simultaneously pushing the pressing members 37 forward and pushing the operating parts 44 of the separating members 41 rearward.

This completes the operation for mounting the developer cartridge 7 in the drum cartridge 6. At this time, the developing roller 9 is in contact with the front side of the photosensitive drum 8. That is, the developer cartridge 7 is disposed in the contact position. Also at this time, the first urging members 38 are compressed to a shorter length than when the developer cartridge 7 is separated from the drum cartridge 6. The urging force of the first urging members 38 increases as the first urging members 38 are further compressed and is thus adjusted to a first urging force when the operation to mount the developer cartridge 7 in the drum cartridge 6 is completed.

The first contact parts 45 of the separating members 41 also contact the rear ends of the second urging members 47 on the rear side thereof, compressing the second urging members 47. As the second urging members 47 are compressed, the urging force of the second urging members 47 increases and thus is adjusted to a third urging force smaller than the first urging force once the developer cartridge 7 is completely mounted in the drum cartridge 6. In other words, as the developer cartridge 7 moves from the separated position as shown in FIG. 5 to the contact position as shown in FIG. 4, the separating members 41 pivotally move in a manner for adjusting the urging force of the second urging members 47 to the third urging force. Accordingly, when the developer cartridge 7 is mounted in the drum cartridge 6, the pressing members 37 urge the developer cartridge 7 rearward with the first urging force while the separating members 41 simultaneously urge the developer cartridge 7 forward with a smaller urging force than the first urging force (the third urging force). That is, when mounted in the drum cartridge 6, the developer cartridge 7 is urged rearward by a force equivalent to the first urging force minus the third urging force.

In order to remove the developer cartridge 7 from the drum cartridge 6, first the operator lifts the front end of the developer cartridge 7 upward and out of the developer cartridge mounting unit 39 formed in the drum cartridge 6. Next, the operator grips the front end of the developer cartridge 7 and pulls the developer cartridge 7 upward and out of the developer cartridge mounting unit 39, thereby completing the operation to separate the developer cartridge 7 from the drum cartridge 6.

In order to mount the process cartridge 5 in the main casing 2, the operator opens the top cover 4 and inserts the process cartridge 5 to a prescribed position in the main casing 2 such that the rear side of the process cartridge 5 is toward the bottom rear in the printer 1 and the front side is toward the upper front. This operation completes the process of mounting the process cartridge 5 in the main casing 2.

4. Operation for Separating the Developer Cartridge from the Photosensitive Drum When printing color images on the printer 1, the developing rollers 9 of all developer cartridges 7 are in contact with the corresponding photosensitive drums 8 (FIG. 1). However, when printing in monochrome (black-only), only the developing roller 9 in the black process cartridge 5K is in contact with the corresponding photosensitive drum 8, while developing rollers 9 in the color process cartridges 5 (the yellow process cartridge 5Y, the magenta process cartridge 5M, and the cyan process cartridge 5C) are separated from the respective photosensitive drums 8.

The body-side levers 81 for separating the developing rollers 9 from the photosensitive drums 8 are provided in the main casing 2. The body-side levers 81 press the second contact parts 46 on the left and right separating members 41 rearward. When the second contact parts 46 are pressed rearward, the separating members 41 rotate clockwise in a left side view. The operating parts 44 on the separating members 41 respectively push the first separating member engaging part 66 of the drive-side gear cover 62 and the second separating member engaging part 74 of the sensor-side gear cover 72 from the rear side thereof.

As the separating members 41 continue to rotate clockwise in a left side view, the developer cartridge 7 begins to move in a direction diagonally upward and forward (separating direction) against the force applied by the pressing members 37. Accordingly, the pressing members 37 move diagonally upward and frontward against the elastic force of the first urging members 38.

At this time, the first urging members 38 are compressed to an even shorter length than the length to which the first urging members 38 are compressed when the developer cartridge 7 is mounted in the drum cartridge 6 (FIG. 5). At this time, the urging each of the forces of the first urging members 38 is adjusted to a second urging force greater than the first urging force.

The pressure-receiving parts 43 of the separating members 41 are also retracted rearward from the second urging members 47, restoring the second urging members 47 from their compressed state to an uncompressed state. Thus, the elastic force of the second urging members 47 is decreased from the third urging force as the second urging members 47 are uncompressed. In other words, as the developer cartridge 7 moves from the contact position toward the separated position, the second urging members 47 apply a fourth urging force smaller than the third urging force to the developer cartridge 7 in a direction for separating the developer cartridge 7 from the photosensitive drum 8. When the separating members 41 subsequently separate from the rear sides of the second urging members 47, the urging force of the second urging members 47 on the separating members 41 is removed. At this time, the second urging members 47 are restored to their natural length.

The force from the body-side levers 81 continues to rotate the separating members 41 clockwise in a left side view until the separating members 41 arrive in the second position. At this time, the developer cartridge 7 is disposed in the separated position, and the process for separating the developing roller 9 from the photosensitive drum 8 is complete.

On the other hand, when printing color images on the printer 1, the developing rollers 9 of all developer cartridges 7 re-contact the corresponding photosensitive drums 8. Specifically, the body-side levers 81 move upper forward, rotating the separating members 41 in a counterclockwise direction in a left side view. As the separating member 41 rotates, the first contact part 45 comes into contact with the second urging member 47. The elastic force of the second urging members 47 is increased as the second urging members 47 are compressed. In other words, as the developer cartridge 7 moves from the separated position to the contact position, the second urging members 47 apply the fourth urging force smaller than the third urging force to the developer cartridge 7. When the separating members 41 arrive in the first position, the developer cartridge 7 is disposed in the contact position, completing the contact process between the developing roller 9 and the photosensitive drum 8.

5. Operational Advantages (1) According to the process cartridge 5 of the embodiments shown in FIGS. 4 and 5, when the developer cartridge 7 is in the contact position shown in FIG. 4, the developer cartridge 7 contacts the photosensitive drum 8 with a force corresponding to the difference between the first urging force and the third urging force. When the developer cartridge 7 is in the separated position shown in FIG. 5, the developer cartridge 7 is pressed toward the photosensitive drum 8 with a second urging force stronger than the first urging force. Accordingly, a relatively strong urging force is applied to the developer cartridge 7 when the developer cartridge 7 is in the separated position, making it possible to reliably move the developer cartridge 7 toward the photosensitive drum 8.

Further, when the developer cartridge 7 is in the contact position, a relatively small force is applied to the developer cartridge 7 in comparison with a state where the developer cartridge is in the separated position. In this way, the force for pushing the developing roller 9 against the photosensitive drum 8 is adjusted to an appropriate amount.

(2) With the process cartridge 5 of the preferred embodiment, the separating members 41 can adjust the elastic force of the second urging members 47 to the third urging force. Accordingly, the process cartridge 5 can reliably adjust the force with which the developing roller 9 is pressed against the photosensitive drum 8.

(3) With the process cartridge 5 of the preferred embodiment shown in FIGS. 4 and 5, the separating members 41 move the developer cartridge 7 between the separated position and the contact position. Accordingly, the separating members 41 serve both to adjust the urging force of the second urging members 47 and to separate the developer cartridge 7 from the photosensitive drum 8 and, hence, the process cartridge 5 does not require separate members for adjusting the urging force of the second urging members 47 and for moving the developer cartridge 7.

(4) Further, the separating members 41 in the process cartridge 5 of the embodiment can be moved through a simple structure in which the separating members 41 are rotated.

(5) With the process cartridge 5 of the embodiment described in FIGS. 4 and 5, the second urging members 47 can apply an urging force to the developer cartridge 7 in addition to the pressure applied by the body-side levers 81 when the developer cartridge 7 is moved from the contact position in FIG. 4 to the separated position in FIG. 5. With this construction, the developer cartridge 7 can move smoothly from the contact position to the separated position.

(6) With the process cartridge 5 of the embodiment described above, one of the second urging members 47 is provided on each of the left and right side walls 32 of the drum cartridge 6. Accordingly, the developer cartridge 7 can be separated from the photosensitive drum 8 evenly across the left-right dimension.

6. Second Embodiment

The developer cartridge 7 according to a second embodiment will be described with reference to FIGS. 6 through 10, wherein like parts and components are designated with the same reference numerals to avoid duplicating description.

In the first embodiment described above, the second urging members 47 are provided on the front side of the separating members 41, with one disposed on the outside of each of the left and right side walls 32 of the drum cartridge 6. However, the arrangement of the second urging members 47 is not limited to that described in the first embodiment.

In the second embodiment, tension members 91 are provided on the drum cartridge 6, with one positioned to the left-right inside of each of the pressing members 37, for pulling the developer cartridge 7 forward.

(1) Drum Cartridge

Figure 6:
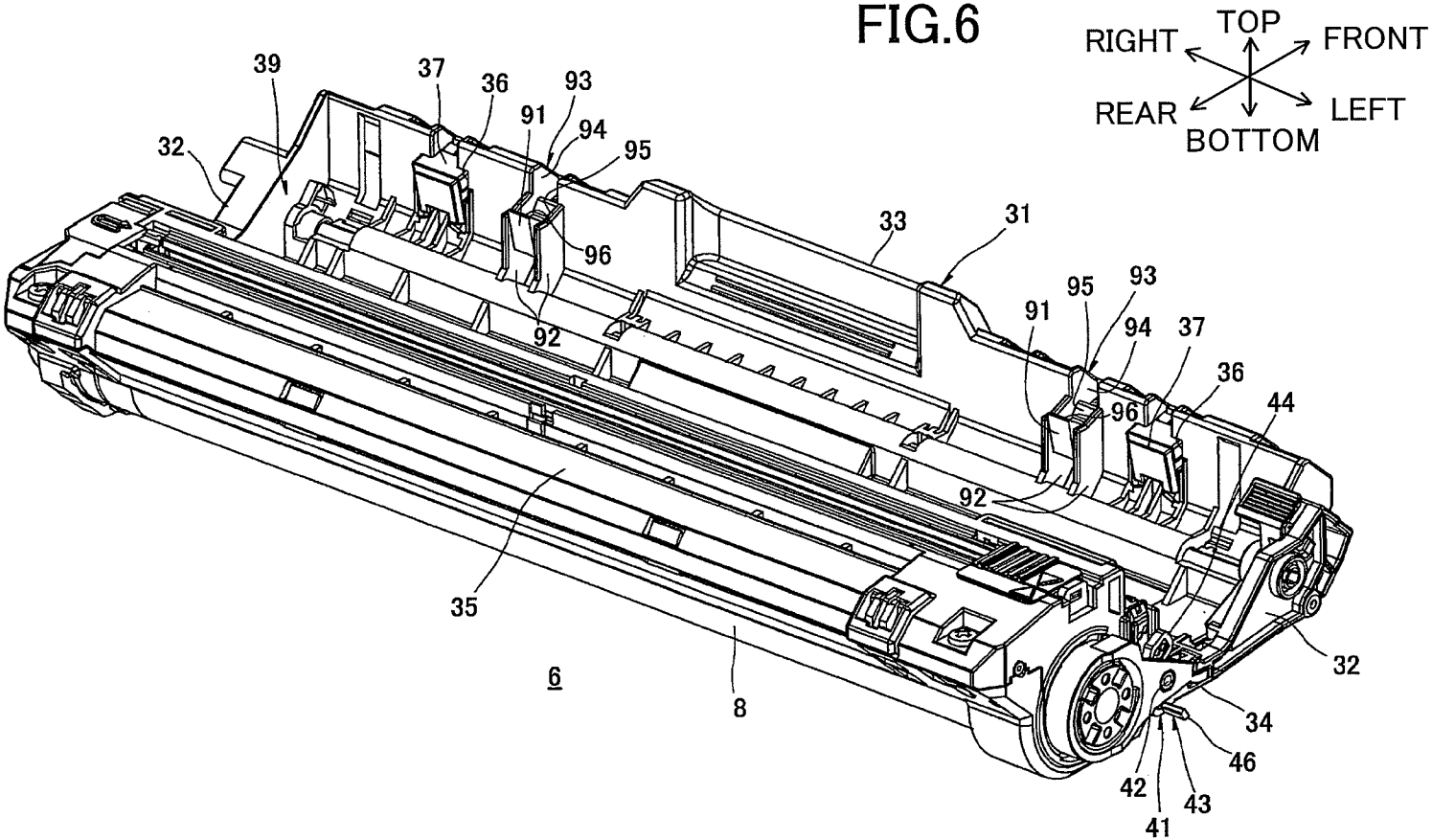
FIG. 6 is a perspective view of a drum cartridge as viewed from diagonally upper and rear according to a second embodiment of the present invention.
Figure 8:
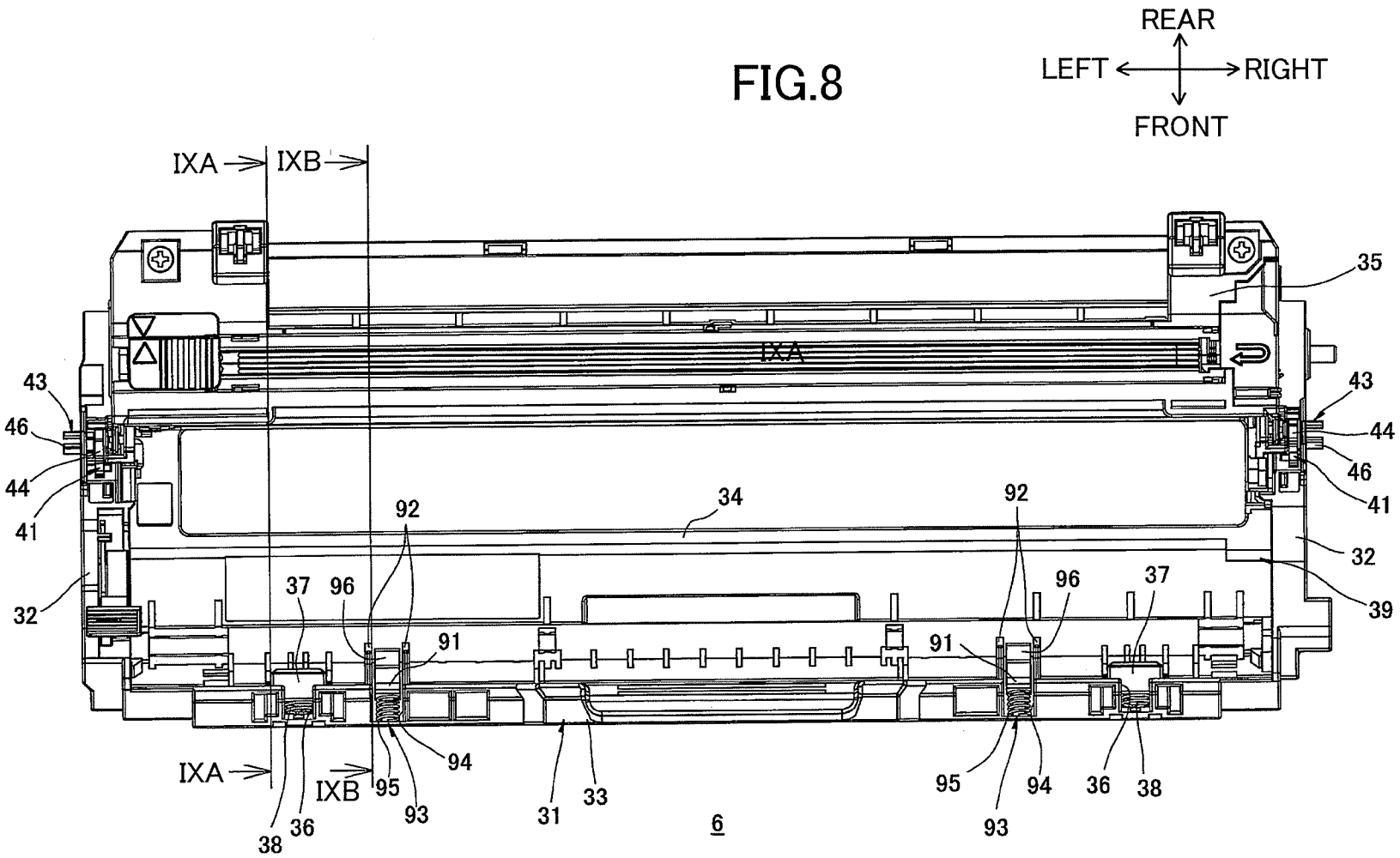
FIG. 8 is a plan view of the drum cartridge according to the second embodiment of the present invention.

As shown in FIGS. 6 and 8, two tension member support parts 93 are formed in the front wall 33 of the drum frame 31 for supporting the tension members 91. The tension member support parts 93 face the interior of the developer cartridge mounting unit 39. The tension member support parts 93 are disposed adjacent to the respective left and right inner sides of the pressing member accommodating units 36 and include a recessed part 94 and a pair of guide parts 92. One each of the tension members 91 and second urging members 95 is disposed in each tension member support part 93.

The recessed parts 94 are generally rectangular in a front view and are recessed forward into the rear surface of the front wall 33. The guide parts 92 are formed as ridge-like members extending vertically and protruding rearward from the left and right peripheral edges of the recessed part 94.

The tension members 91 have a square columnar shape and are generally rectangular in a side view. The tension members 91 are supported in the tension member support parts 93 so as to be capable of sliding in front and rear directions. A fitting groove 96 is formed in each tension member 91. The fitting grooves 96 are notches formed in the top edges of the respective tension members 91 and are generally U-shaped in a side view, with the opening of the "U" formed on the top.

The second urging members 95 are helical tension springs capable of extending in the direction that the tension members 91 slide. Each second urging member 95 has one end connected to the front end of the corresponding tension member 91, and the other end connected to the front wall of the corresponding tension member support part 93. With this construction, the tension members 91 are constantly urged forward.

(2) Developer Cartridges

Figure 7:
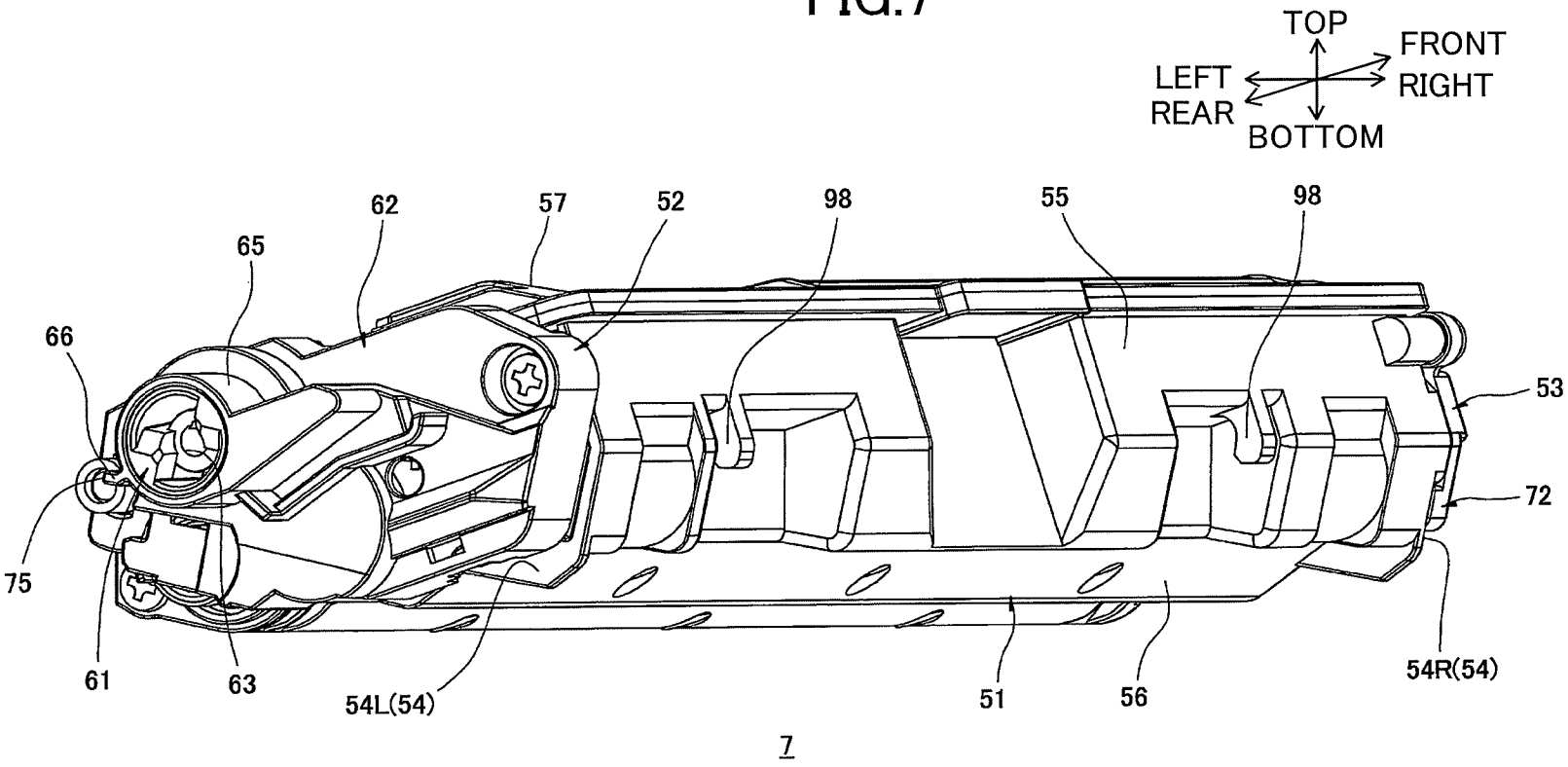
FIG. 7 is a perspective view of a developer cartridge as viewed from diagonally front and left according to the second embodiment of the present invention.

As shown in FIG. 7, the cartridge frame 51 is provided with fitting parts 98 that can be fitted into the fitting grooves 96 formed in the tension members 91. The fitting parts 98 are generally rod-shaped and extend diagonally downward and forward from the front wall 55 of the cartridge frame 51. The bottom ends of the fitting parts 98 are slightly bent downward. When the developer cartridge 7 is mounted in the drum cartridge 6, the fitting parts 98 are fitted into the fitting grooves 96 of the developer cartridge 7.

(3) Operation for Separating the Developer Cartridge from the Photosensitive Drum In the second embodiment, when the developer cartridge 7 is mounted in the drum cartridge 6, the developer cartridge 7 is accommodated in the developer cartridge mounting unit 39 while simultaneously pressing the pressing members 37 forward and pulling the tension members 91 rearward. At this time, the developing roller 9 is in contact with the front side of the photosensitive drum 8. Hence, the developer cartridge 7 is in the contact position.

Figure 9A:
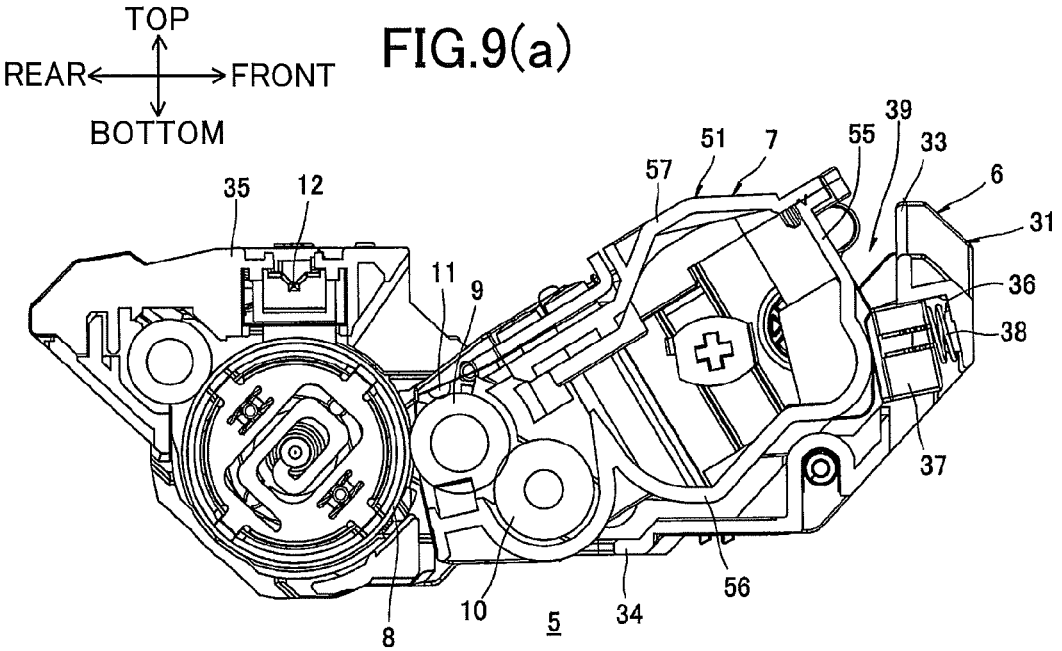
FIG. 9(*a*) is a cross-sectional view of a process cartridge taken along a line A-A of FIG. 8 when the developer cartridge is in a contact position according to the second embodiment of the present invention.
Figure 9B:
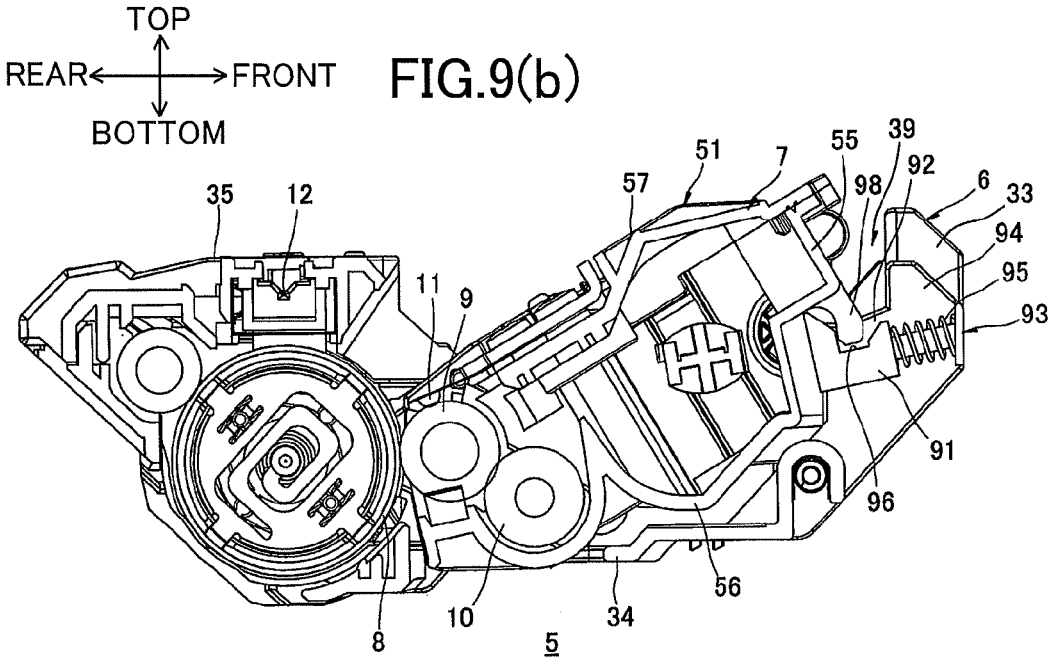
Figure 10B:
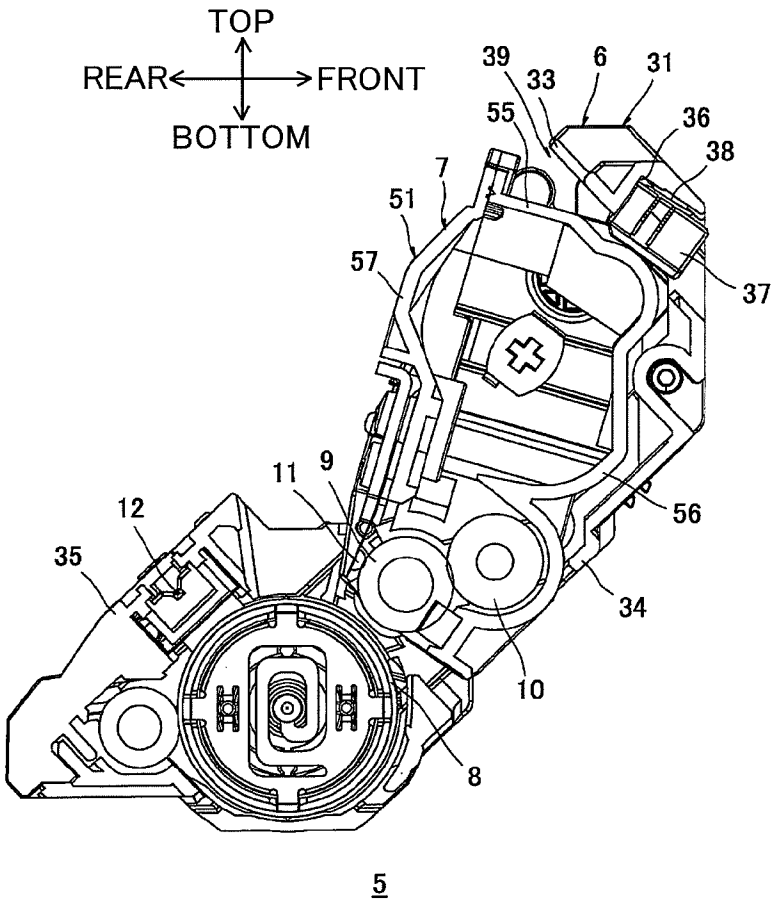
FIG. 10(*a*) is a cross-sectional view of the process cartridge taken along the line A-A of FIG. 8 when the developer cartridge is in a separated position according to the second embodiment of the present invention.
Figure 10A:
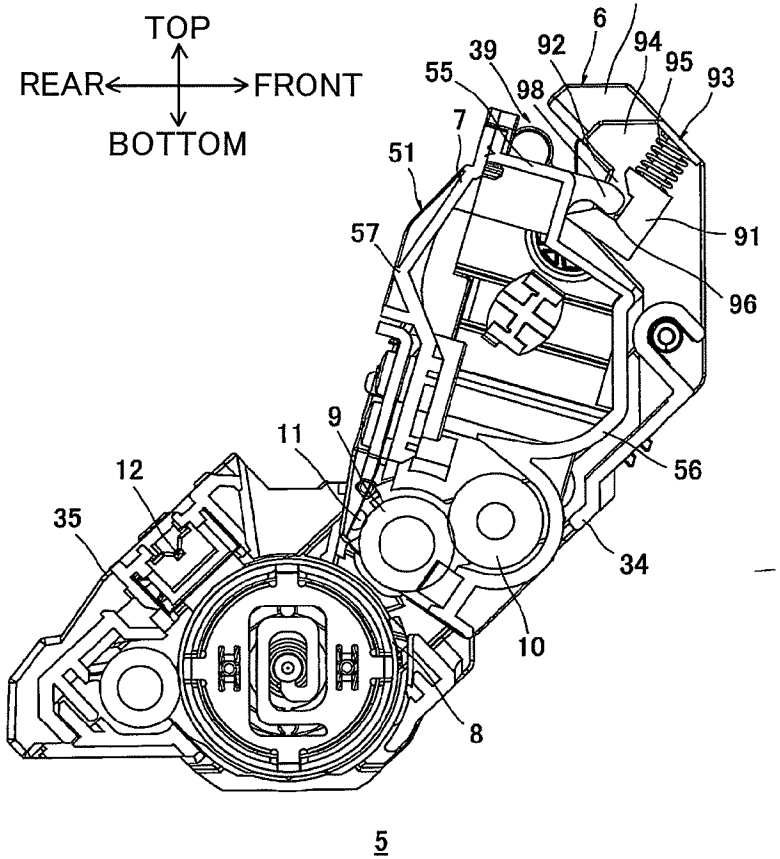

Also at this time, the first urging members 38 are compressed to a shorter length than the compressed length when the developer cartridge 7 is separated from the drum cartridge 6, as shown in FIG. 9(*a*). In this way, the elastic force of the first urging members 38 is adjusted to the first urging force.

In addition, the second urging members 95 are extended to a length greater than that when the developer cartridge 7 is separated from the drum cartridge 6. In this way, the urging force of the second urging members 95 is adjusted to the third urging force smaller than the first urging force.

Thus, when the developer cartridge 7 is mounted in the drum cartridge 6, the pressing members 37 urge the developer cartridge 7 rearward with the first urging force, while the tension members 91 urge the developer cartridge 7 forward with a smaller urging force than the first urging force (the third urging force). Hence, when mounted in the drum cartridge 6, the developer cartridge 7 is urged rearward by a force found by subtracting the third urging force from the first urging force.

To separate the developing roller 9 from the photosensitive drum 8, the body-side levers 81 provided in the main casing 2 press the pressure-receiving parts 43 of the left and right separating members 41 rearward. As a result, the separating member 41 is rotated clockwise in a left side view, causing the operating parts 44 of the separating members 41 to contact the first separating member engaging part 66 of the drive-side gear cover 62 and the second separating member engaging part 74 of the sensor-side gear cover 72 from the rear side thereof. As the separating members 41 continue to rotate clockwise in a left side view, the developer cartridge 7 begins to move diagonally upward and forward (separating direction) against the pressure applied by the pressing members 37. As a result, the pressing members 37 move diagonally upward and forward against the urging force of the first urging members 38.

At this time, the first urging members 38 are compressed to an even shorter length than their compressed length when the developer cartridge 7 is mounted in the drum cartridge 6, i.e., the developer cartridge 7 is in the contact position. In this way, the urging force of the first urging members 38 is adjusted to the second urging force greater than the first urging force.

Further, as the tension members 91 are retracted forward, the second urging members 95 are restored from their tension state. Consequently, the urging force of the second urging members 95 is reduced from the third urging force as the second urging members 95 are restored from their tension state to a normal state. Hence, as the developer cartridge 7 moves from the contact position to the separated position, the second urging members 95 urge the developer cartridge 7 in a direction away from the photosensitive drum 8 at the fourth urging force smaller than the third urging force.

When the separating members 41 arrive in the second position, the developer cartridge 7 is disposed in the separated position and the operation for separating the developing roller 9 from the photosensitive drum 8 is complete.

On the other hand, in order to perform color print in the printer 1, the developing rollers 9 of all developer cartridges 7 re-contact the corresponding photosensitive drums 8. Similarly to the first embodiment, the body-side levers 81 move upper frontward, rotating the separating members 41 in a counterclockwise direction in a left side view. As the separating members 41 rotate, the elastic force of the second urging members 95 is increased as the second urging members 95 are extended. In other words, as the developer cartridge 7 moves from the separated position toward the contact position, the second urging members 95 apply the fourth urging force to the developer cartridge 7. When the separating members 41 arrive in the first position, the developer cartridge 7 is disposed in the contact position, completing the contact process between the developing roller 9 and the photosensitive drum 8

(4) Operational Advantages

The second embodiment can obtain the same operational advantages described in the first embodiment.

7. Third Embodiment

Next, the developer cartridge 7 according to a third embodiment will be described with reference to FIG. 11, wherein like parts and components are designated with the same reference numerals used in the first embodiment to avoid duplicating description.

In the first embodiment described above, the second urging members 47 are disposed on the front side of the pressure-receiving parts 43 constituting the separating members 41. However, second urging members 347 according to the third embodiment are disposed on the rear side of the operating parts 44 of the separating members 41, as illustrated in FIG. 11.

Specifically, the rear end of each second urging member 347 is supported on the corresponding side wall 32 of the drum frame 31, while the front end is positioned on the rear side of the operating part 44 of the separating member 41 and is capable of contacting the operating part 44. In other words, the operating parts 44 of the separating members 41 are disposed between the respective second urging members 347 and the developer cartridge 7.

Figure 11A:
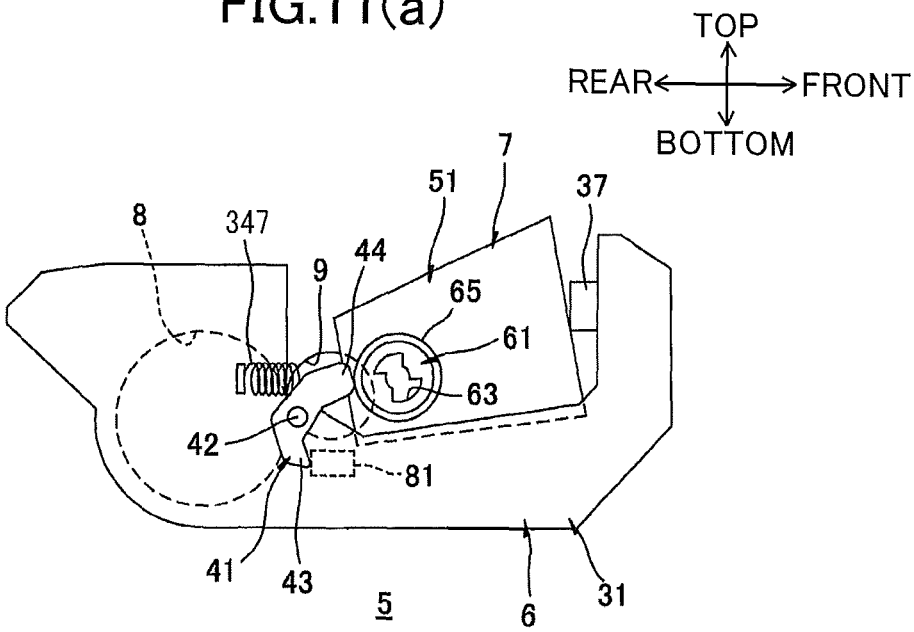
FIG. 11(*a*) is a schematic view of a process cartridge when a developer cartridge is in a contact position according to a third embodiment of the present invention.
Figure 11B:
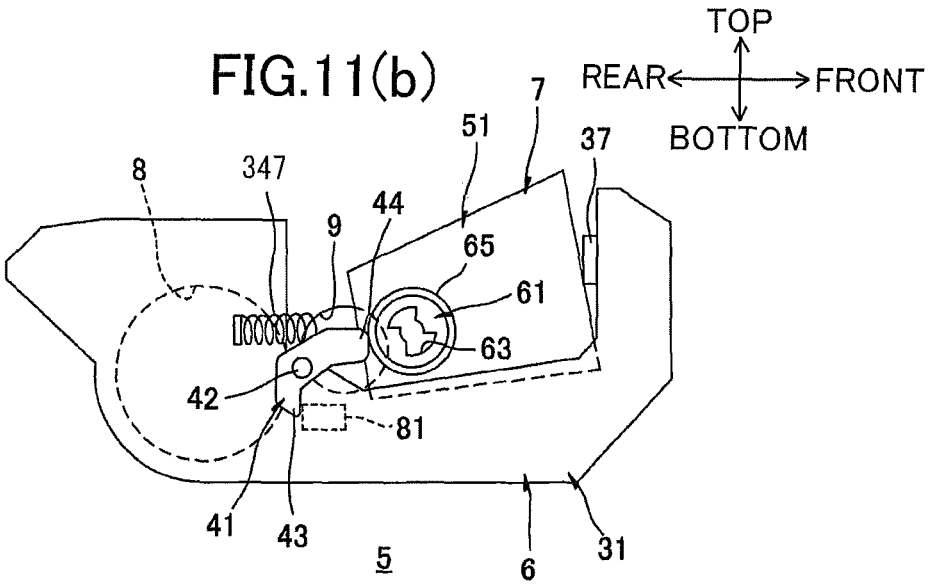

When the developer cartridge 7 is disposed in the contact position shown in FIG. 11(*a*), the urging force of the first urging member 38 is adjusted to the first urging force, as described in the first embodiment. At this time, the operating parts 44 of the separating members 41 contact the front ends of the respective second urging members 347, compressing the second urging members 347 in the front-rear direction. This compression adjusts the urging force of the second urging members 347 to the third urging force smaller than the first urging force.

When the developer cartridge 7 is disposed in the separated position shown in FIG. 11(*b*), as in the first embodiment the urging force of the first urging members 38 is adjusted to the second urging force greater than the first urging force. At this time, the operating parts 44 of the separating members 41 are retracted forward from the second urging members 347, restoring the second urging members 347 from their compressed state. Thus, the elastic force of the second urging members 347 is decreased from the third urging force as the second urging members 347 are uncompressed, thereby adjusting the urging force of the second urging members 347 to the fourth urging force smaller than the third urging force.

With the configuration of the third embodiment described above, the second urging members 347 can apply an urging force to the developer cartridge 7 via the separating members 41. Accordingly, an urging force from the second urging members 347 can be applied to the developer cartridge 7 while the separating members 41 maintain stable contact with the developer cartridge 7.

8. Fourth Embodiment

Next, the developer cartridge 7 according to a fourth embodiment will be described with reference to FIG. 12, wherein like parts and components are designated with the same reference numerals used in the first embodiment to avoid duplicating description.

In the first embodiment described above, the second urging members 47 are disposed on the front side of the pressure-receiving parts 43 constituting the separating members 41. In the fourth embodiment, however, one of the second urging members 447 is disposed between the rotational shafts 42 of the left-side separating member 41 and the coupling collar 65 of the drive-side gear cover 62. Remaining of the second urging members 447 is disposed between the rotational shaft 42 of the right-side separating member 41 and the exposure opening 73 of the sensor-side gear cover 72. The second urging members 447 are aligned with the operating parts 44 of the separating members 41 in the left-right direction.

Specifically, the rear end of each second urging member 447 is supported on the rotational shaft 42 of the corresponding separating member 41, while the front end of each second urging member 447 is disposed farther forward than the rotational shaft 42 and is capable of contacting the coupling collar 65 and the drive-side gear cover 62, respectively. Hence, the second urging members 447 are oriented in the front rear directions.

Figure 12A:
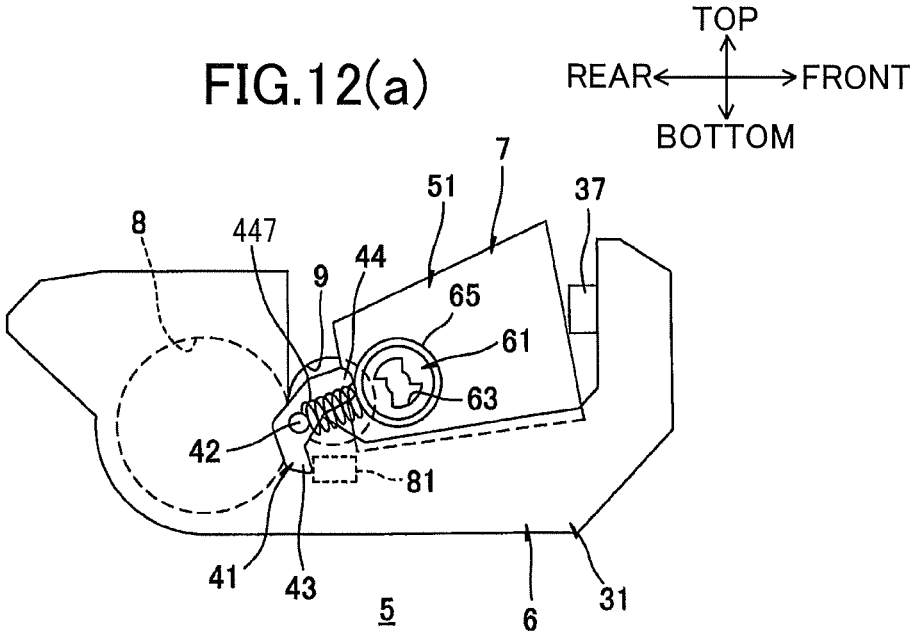
FIG. 12 (*a*) is a schematic view of a process cartridge when a developer cartridge is in a contact position according to a fourth embodiment of the present invention.
Figure 12B:
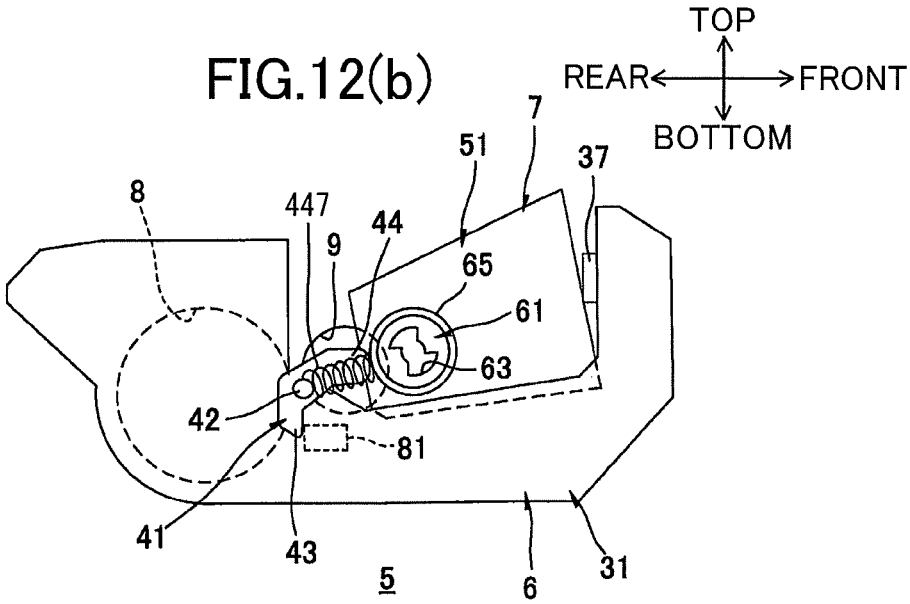

When the developer cartridge 7 is disposed in the contact position shown in FIG. 12(*a*), the urging force of the first urging members 38 is adjusted to the first urging force, as described in the first embodiment. At this time, the coupling collar 65 and the drive-side gear cover 62 respectively contact the front ends of each of the second urging members 447, compressing the second urging members 447 in the front-rear direction. Through this compression, the urging force of the second urging members 447 is adjusted to the third urging force smaller than the first urging force.

When the developer cartridge 7 is in the separated position shown in FIG. 12(*b*), as in the first embodiment, the urging force of the first urging members 38 is adjusted to the second urging force greater than the first urging force. At this time, the coupling collar 65 and the drive-side gear cover 62 are respectively retracted forward from each of the second urging members 447, restoring the second urging members 447 from its compressed state to its normal state. Thus, the elastic force of the second urging members 447 is decreased from the third urging force as the second urging members 447 are uncompressed, thereby adjusting the force of the second urging members 447 to the fourth urging force smaller than the third urging force.

According to the fourth embodiment described above, the second urging members 447 are capable of expanding and contracting along the direction in which the developer cartridge 7 is separated from the photosensitive drum 8 (forward). Accordingly, the urging force of the second urging members 447 can be more efficiently utilized in the operation for separating the developer cartridge 7 from the photosensitive drum 8.

9. Variations of the Embodiments

While the invention has been described in detail with reference to the embodiments thereof, it would be apparent to those skilled in the art that various changes and modifications may be made therein without departing from the spirit of the invention.

While the first urging members 38 and the second urging members 47, 95, 347, or 447 are provided in the process cartridge 5 of the preferred embodiment, as described above, these components may be provided on the main casing 2 instead. Further, the first urging members 38 and the second urging members 47, 95, 347, or 447 are configured of helical compression springs and helical tension springs in the preferred embodiments, but the first urging members 38 and second urging members 47, 95, 347, or 447 may be configured of any elastically deformable material, such as a rubber material, leaf springs, or the like.

While the first urging members 38 and the second urging members 47, 95, 347, or 447 are provided in the both ends in the right-left direction of the process cartridge 5 of the preferred embodiment, as described above, these components may be provided in one of the both ends in the right-left direction of the process cartridge 5, provided that the developing rollers 9 are reliably in contact with and separated from the corresponding photosensitive drums 8.

What is claimed is:

1. A process unit comprising:

a photosensitive unit provided with a photosensitive body;

a developer unit provided with a developing member configured to carry developing agent thereon, the developer unit configured to be moved between a contact position where the developing member is in contact with the photosensitive body and a separated position where the developing member is separated from the photosensitive body;

a first urging member configured to urge the developer unit so as to move the developer unit from the separated position to the contact position, the first urging member configured to urge the developer unit with a first urging force when the developer unit is in the contact position, whereas the first urging member is configured to urge the developer unit with a second urging force greater than the first urging force when the developer unit is in the separated position; and a second urging member configured to urge the developer unit so as to move the developer unit from the contact position to the separated position, the second urging member configured to urge the developer unit with a third urging force smaller than the first urging force when the developer unit is in the contact position, whereas the second urging member is configured to urge the developer unit with a fourth urging force smaller than the third urging force when the developer unit is moved from the separated position to the contact position.

2. The process unit according to claim 1, wherein the photosensitive unit is provided with a moving member configured to change an urging force of the second urging member from the fourth urging force to the third urging force as the developer unit is moved from the separated position to the contact position.

3. The process unit according to claim 2, wherein the moving member is configured to move the developer unit between the contact position and the separated position.

4. The process unit according to claim 2, wherein the moving member is rotatably provided in the photosensitive unit.

5. The process unit according to claim 2, wherein the moving member comprises a receiving part configured to receive a pressure from outside and an operating part configured to press the developer unit based on the pressure received in the receiving part.

6. The process unit according to claim 2, wherein the moving member is disposed between the second urging member and the developer unit.

7. The process unit according to claim 1, wherein the second urging member is configured to extend and contract in a direction in which the developer unit separates from the photosensitive body.

8. The process unit according to claim 1, wherein the second urging member is provided at each end of the photosensitive unit in an axial direction of the developing member.

9. A photosensitive unit to which a developer unit provided with a developing member is detachably mounted, the photosensitive unit comprising:

a photosensitive body, wherein the developer unit is movable between a contact position where the developing member is in contact with the photosensitive body and a separated position where the developing member is separated from the photosensitive body;

a first urging member configured to urge the developer unit so as to move the developer unit from the separated position to the contact position, the first urging member configured to urge the developer unit with a first urging force when the developer unit is in the contact position, whereas the first urging member is configured to urge the developer unit with a second urging force greater than the first urging force when the developer unit is in the separated position; and a second urging member configured to urge the developer unit so as to move the developer unit from the contact position to the separated position, the second urging member configured to urge the developer unit with a third urging force smaller than the first urging force when the developer unit is in the contact position, whereas the second urging member is configured to urge the developer unit with a fourth urging force smaller than the third urging force when the developer unit is moved from the separated position to the contact position.

* * * * *